US008550616B2

(12) United States Patent
Gordon

(10) Patent No.: US 8,550,616 B2
(45) Date of Patent: Oct. 8, 2013

(54) METHOD OF MONITORING GEL ACCUMULATION IN A DRUM MAINTENANCE UNIT

(75) Inventor: Michael Cameron Gordon, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 395 days.

(21) Appl. No.: 13/082,587

(22) Filed: Apr. 8, 2011

(65) Prior Publication Data

US 2012/0256983 A1 Oct. 11, 2012

(51) Int. Cl.

| | |
|---|---|
| ***B41J 2/01*** | (2006.01) |
| *B41J 2/17* | (2006.01) |
| *B41J 2/175* | (2006.01) |
| *B41F 35/00* | (2006.01) |
| *B41F 33/00* | (2006.01) |
| *B41L 41/00* | (2006.01) |

(52) U.S. Cl.
USPC ..... 347/103; 347/84; 347/85; 347/88; 347/101; 101/425; 101/483

(58) Field of Classification Search
USPC ..... 347/85, 88, 101, 103; 101/425, 483
See application file for complete search history.

(56) References Cited

U.S. PATENT DOCUMENTS

| | | | | |
|---|---|---|---|---|
| 6,068,372 | A | 5/2000 | Rousseau et al. | |
| 6,176,575 | B1 | 1/2001 | Crawford et al. | |
| 6,357,854 | B1 * | 3/2002 | Igval et al. | 347/36 |
| 6,505,009 | B2 * | 1/2003 | Henricus et al. | 399/35 |
| 6,755,519 | B2 | 6/2004 | Gelbart et al. | |
| 7,036,920 | B2 | 5/2006 | Rousseau et al. | |
| 7,114,795 | B2 * | 10/2006 | Shimura et al. | 347/36 |
| 7,677,717 | B2 * | 3/2010 | Islam et al. | 347/103 |
| 7,866,783 | B2 * | 1/2011 | Tsuji et al. | 347/19 |
| 2005/0134666 | A1 | 6/2005 | Rousseau | |
| 2007/0139496 | A1 | 6/2007 | Leighton et al. | |
| 2007/0146459 | A1 | 6/2007 | Gault et al. | |
| 2007/0146460 | A1 | 6/2007 | Gordon et al. | |
| 2007/0146461 | A1 | 6/2007 | Islam et al. | |
| 2010/0231674 | A1 | 9/2010 | Domoto et al. | |
| 2010/0271451 | A1 | 10/2010 | Burress et al. | |

* cited by examiner

*Primary Examiner* — Laura Martin
*Assistant Examiner* — Jeremy Bishop
(74) *Attorney, Agent, or Firm* — Maginot, Moore & Beck, LLP

(57) ABSTRACT

A process is implemented in a printer having a release agent application system that enables a controller in the printer to detect gel ink in the release agent application system exceeding a predetermined threshold. The process monitors a plurality of print characteristics with reference to print data and quantifies a risk of gel ink developing in the release agent application system. The print characteristics include a print area value identifying a total surface area of a print, an inked area value identifying an area of surface area covered with ink, and a print type indicating whether the print is a simplex print or a duplex print.

18 Claims, 5 Drawing Sheets

METHOD OF MONITORING GEL ACCUMULATION IN A DRUM MAINTENANCE UNIT

TECHNICAL FIELD

The method described below relates to phase change inkjet printers, and more particularly to release agent application systems used in these printers.

BACKGROUND

Phase change inkjet printers receive phase change ink in a solid form, commonly referred to as ink sticks. Solid ink sticks are loaded into a printer and then melted to produce liquid ink that is used to form images on print media. Phase change inkjet printers form images using either a direct or an offset (sometimes called indirect) print process. In a direct print process, melted ink is jetted directly onto print media to form images. In an offset print process, melted ink is jetted onto a surface of a rotating member, such as the surface of a rotating drum, belt, or band. Print media are moved proximate the surface of the rotating member in synchronization with the ink images formed on the surface. The print media are then pressed against the surface of the rotating member as the media passes through a nip formed between the rotating member and a transfix roller. The ink images are transferred and affixed to the print media by the pressure in the nip.

Offset phase change inkjet printers utilize drum maintenance units (DMUs) to facilitate the transfer of ink images to the print media. A DMU is usually equipped with a reservoir that contains a fixed supply of release agent (e.g., silicon oil), and an applicator for delivering the release agent from the reservoir to the surface of the rotating member. One or more elastomeric metering blades are also used to meter the release agent onto the transfer surface at a desired thickness and to divert excess release agent and un-transferred ink pixels to a reclaim area of the drum maintenance system. The collected release agent is filtered and returned to the reservoir for reuse.

A small amount of release agent is removed from the system with each print. The control system of the printer utilizes a life-sensing process to predict when the supply of release agent is likely to be depleted so an alert can be generated indicating that the DMU is in need of replacement before the supply is exhausted. Volume sensors are impractical so previously known life-sensing processes involve various combinations of open loop print counting and predictions of oil mass remaining in the source following detection of a float sensor reaching a predetermined level in the source. An end-of-life condition is sensed in response to air being detected in the oil intake from the source.

As the supply of release agent in the DMU diminishes, the amount of ink material collected from the rotating member accumulates in the DMU. This ink material can combine with the release agent to form a high viscosity gel-like mixture. As the gel accumulates in the release agent supplied to the applicator, the gel may begin to adhere to the elastomeric blades of the DMU and adversely impact metering performance. In some cases, the gel may contaminate the transfer surface resulting in print defects and inkjet damage. Gel related defects and failures are cumulative and typically occur near the end of the life of the DMU.

Previously known life-sensing processes are helpful in predicting an oil level in the supply of release agent in a DMU. These processes, however, do not take into consideration the factors that lead to gel formation and accumulation in the DMU, and, therefore, are not useful in predicting when a DMU is at risk for gel related failures.

SUMMARY

A method of monitoring a release agent application system of an imaging device to predict gel formation and accumulation has been developed. The method includes identifying a plurality of print characteristics for a print to be printed by an imaging device, generating a print gel score with reference to the plurality of print characteristics, adding the print gel score to an overall gel score for a release agent application system of the imaging device, comparing the overall gel score to a predetermined gel score threshold, and modifying operation of the imaging device in response to the comparison indicating that the overall gel score is greater than the predetermined gel score threshold.

Another method of monitoring a release agent application system has been developed that predicts gel formation and accumulation with reference to simplex and duplex prints. The method includes identifying a plurality of print characteristics for a print performed by an imaging device, the plurality of print characteristics including a print area value identifying a total surface area of the print, an inked area value identifying an area of the surface area covered with ink, and a print type indicating whether the print is a simplex print or a duplex print, incrementing a total simplex print area value and a total simplex inked area value in response to the print type indicating that the print is a simplex print, incrementing a total duplex print area value and a total duplex inked area value in response to the print type indicating that the print is a duplex print, generating a simplex gel score with reference to the total simplex print area value and the total simplex inked area value, generating a duplex gel score with reference to the total duplex print area value and the total duplex inked area value, summing the simplex gel score and the duplex gel score to generate an overall gel score, comparing the overall gel score to a predetermined gel score threshold, and modifying operation of the imaging device in response to the comparison to the predetermined gel score threshold indicating the overall gel score is greater than the gel score threshold.

These methods may be used in a method for detecting a likelihood of gel ink developing in a release agent application system within an inkjet printer. The method includes identifying a plurality of print characteristics from print data used to operate ink ejecting devices in the inkjet printer, identifying a risk of gel ink developing in the release agent application system with reference to the identified plurality of print characteristics, and operating the inkjet printer with reference to the identified risk.

DETAILED DESCRIPTION

Figure 1:
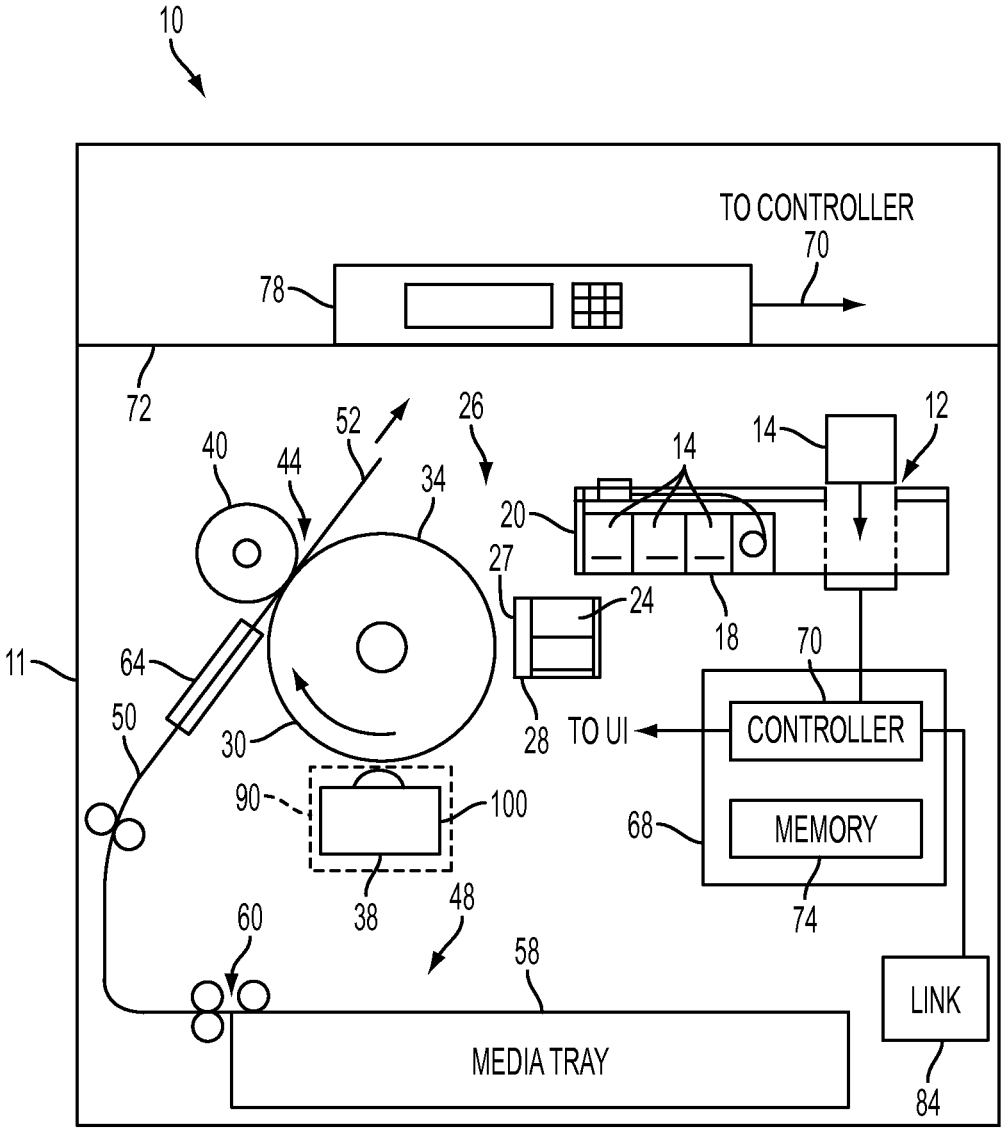
FIG. 1 is a schematic view of an indirect phase change inkjet printing system including a rotatable image receiving member having an image transfer surface.

The description below and the accompanying figures provide a general understanding of the environment for the method disclosed herein as well as the details for the method. In the drawings, like reference numerals are used throughout to designate like elements. The word "printer" as used herein encompasses any apparatus that generates an image on media with ink. The word "printer" includes, but is not limited to, a digital copier, a bookmaking machine, a facsimile machine, a multi-function machine, or the like. The terms "simplex" and "duplex" used in reference to the term "prints" describe whether an ink image is formed on one side of the sheet, i.e., "simplex print," or both sides of the print, i.e., "duplex print."

Figure 2:
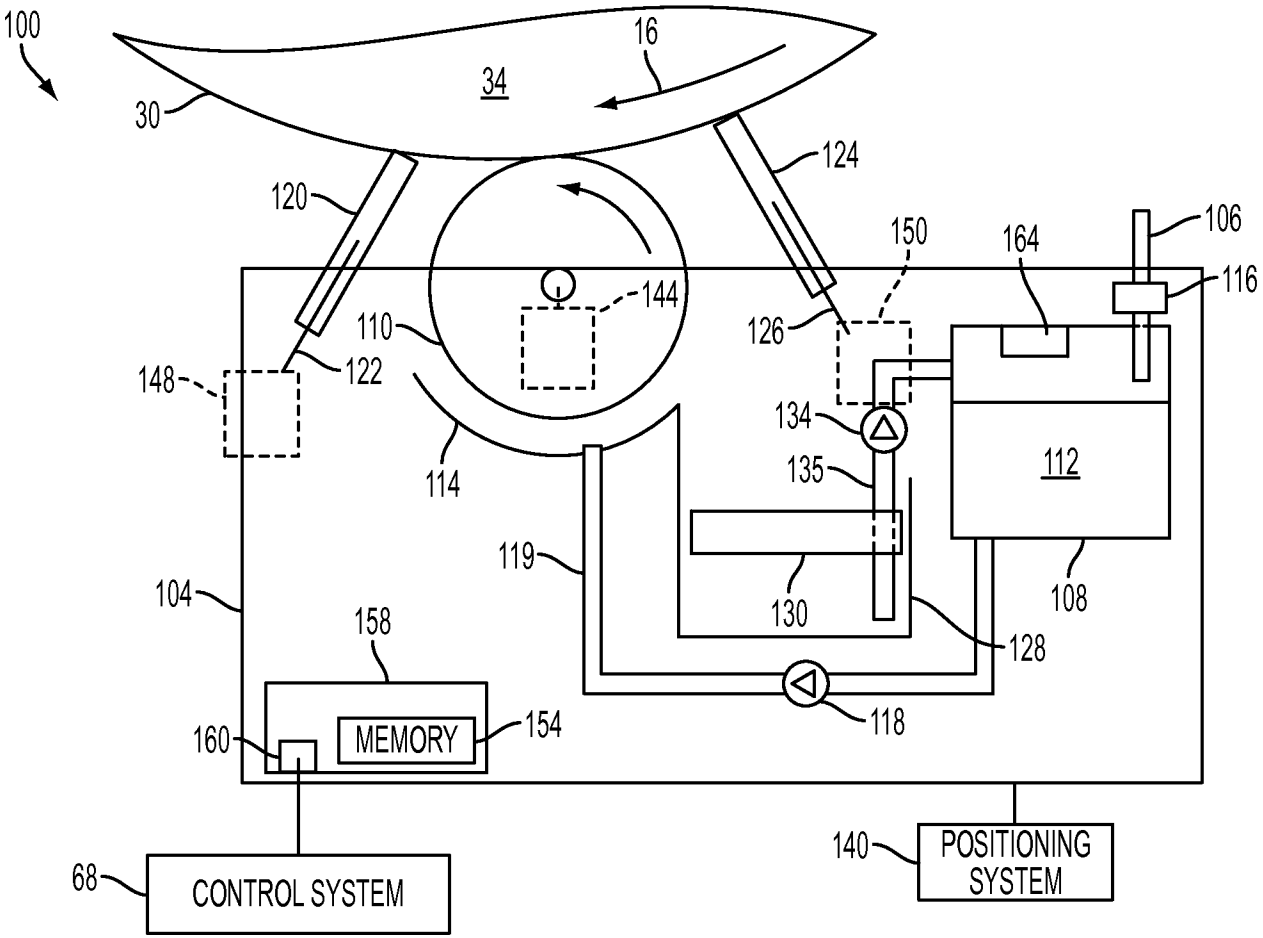
FIG. 2 is a schematic view of drum maintenance system of the printing system of FIG. 1 in an engaged position with respect to the image transfer surface.

FIG. 1 is a side schematic view of a phase change inkjet printing device 10 that utilizes a moving image transfer surface 30 to transfer image material to a print sheet. The device 10 is equipped with a release agent application system 100, also referred to as a drum maintenance unit (DMU), that meters release agent onto the surface 30 prior to each print cycle and removes and stores any excess release agent and un-transferred ink from the surface 30 after each print cycle. To perform these tasks, the DMU includes a reservoir, an applicator, and one or more elastomeric blades (FIG. 2). The reservoir contains a fixed supply of release agent for the DMU. The applicator delivers the release agent from the reservoir to the transfer surface 30. The blade(s) meter the release agent onto the transfer surface to a desired thickness and divert excess release agent, ink and debris from the surface 30 to a reclaim area of the DMU for reuse by the system.

The imaging device 10 of FIG. 1 includes a control system 68 that is operatively connected to the DMU. The control system is configured to monitor DMU performance and to generate an EOL fault when the DMU is in need of replacement. As noted above, the ink material collected in the DMU may combine with the release agent to form a high viscosity gel that accumulates in the DMU over time. This gel can contaminate the components of the DMU and adversely impact performance and, in some cases, affect equipment operation. In accordance with the present disclosure, a gel-based life sensing process has been developed that enables the control system to determine when the DMU is at risk for gel related failures so that an EOL fault may be generated prior to the occurrence of these failures.

FIG. 1 depicts the relationship between the DMU 100 and the other components of the exemplary phase change inkjet printing device 10. The device 10 includes a housing 11 that supports and at least partially encloses an ink loader 12, a printing system 26, a media supply and handling system 48, and a control system 68. The ink loader 12 receives and delivers solid ink to a melting device for generation of liquid ink. The printing system includes a plurality of inkjet ejectors that is fluidly connected to receive the melted ink from the melting device. The inkjet ejectors emit drops of liquid ink onto the image transfer surface 30 under the control of system 68. The media supply and handling system 48 extracts media from one or more media supplies in the printer 10, synchronizes delivery of the media to a transfix nip 44 for the transfer of an ink image from the image receiving surface to the media, and then delivers the printed media to an output area.

In more detail, the ink loader 12 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the printer 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 80° C. to 130° C. In some embodiments, alternative ink loader configurations and ink forms are used.

The melted ink from the melting assembly 20 is directed gravitationally or by actuated systems, such as pumps, to a melt reservoir 24. A separate melt reservoir 24 may be provided for each ink color, shade, or composition used in the printer 10. Alternatively, a single reservoir housing may be compartmentalized to contain the differently colored inks. As depicted in FIG. 1, the ink reservoir 24 comprises a printhead reservoir that supplies melted ink to inkjet ejectors 27 formed in the printhead(s) 28. The ink reservoir 24 may be integrated into or intimately associated with the printhead 28. In alternative embodiments, the reservoir 24 is a separate or independent unit from the printhead 28. Each melt reservoir 24 may include a heating element (not shown) operable to heat the ink contained in the corresponding reservoir to a temperature suitable for melting the ink and/or maintaining the ink in liquid or molten form, at least during appropriate operational states of the printer 10.

The printing system 26 includes at least one printhead 28. One printhead 28 is shown in FIG. 1 although any suitable number of printheads 28 may be used. The printhead 28 is operated in accordance with firing signals generated by the control system 68 to eject drops of ink toward the image receiving surface 30. The device 10 of FIG. 1 is an indirect printer configured to use an indirect printing process in which the drops of ink are ejected onto the intermediate transfer surface 30 and then transferred to print media. In alternative embodiments, the device 10 is configured to eject the drops of ink directly onto print media.

The image receiving member 34 is shown as a drum in FIG. 1, although in alternative embodiments the image receiving member 34 is a moving or rotating belt, band, roller or other similar type of structure. A transfix roller 40 is configured for movement into and out of engagement with the image receiving member and the control system 68 selectively operates an actuator (not shown) to implement this movement. The transfix roller 40 is loaded against the transfer surface 30 of the image receiving member 34 to form a nip 44 through which sheets of print media 52 pass. The sheets are fed through the nip 44 in timed registration with an ink image formed on the transfer surface 30 by the inkjets 27 of the printhead 28. Pressure (and in some cases heat) is generated in the nip 44 to facilitate the transfer of the ink drops from the surface 30 to the print media 52 in conjunction with release agent to substantially prevent the ink from adhering to the image receiving member 34.

The media supply and handling system 48 of printer 10 transports print media along a media path 50 that passes through the nip 44. The media supply and handling system 48 includes at least one print media source, such as supply tray 58. The media supply and handling system also includes suitable mechanisms, such as rollers 60, which may be driven rollers or idle rollers, as well as baffles, deflectors, and the like, for transporting media along the media path 50.

Media conditioning devices may be positioned at various points along the media path 50 to prepare the print media thermally to receive melted phase change ink. In the embodiment of FIG. 1, a preheating assembly 64 is utilized to bring print media on media path 50 to an initial predetermined temperature prior to reaching the nip 44. Media conditioning devices, such as the preheating assembly 64, may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media.

A control system 68 aids in operation and control of the various subsystems, components, and functions of the printer 10. The control system 68 is operatively connected to one or more image sources, such as a scanner, to receive and manage image data from the sources and to generate control signals that are delivered to the components and subsystems of the printer. Some of the control signals are based on the image data, such as the firing signals, and these firing signals operate the printheads as noted above. Other control signals, for example, control the operating speeds, power levels, timing, actuation, and other parameters, of the system components to cause the imaging device 10 to operate in various states, modes, or levels of operation, referred to collectively herein as operating modes. These operating modes include, for example, a startup or warm up mode, shutdown mode, various print modes, maintenance modes, and power saving modes.

The control system is configured to ascertain relevant print job characteristics and attributes in a suitable manner such as by parsing image data or by monitoring the components and sensors of the systems of the imaging device. The print characteristics and attributes that may be ascertained by the control system include print media type, print size, fill or coverage level (i.e., percent of the print covered with ink), and whether the print is a simplex (image on one side) or a duplex (image on both sides) print.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a micro-controller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively connected to the user interface 78 to receive signals indicative of selections and other information input to the user interface 78 by a user or operator of the device. Controller 70 is operatively connected to the user interface 78 to display information to a user or operator including selectable options, machine status, consumable status, and the like. The controller 70 may also be coupled to a communication link 84, such as a computer network, for receiving image data and user interaction data from remote locations.

Figure 3:
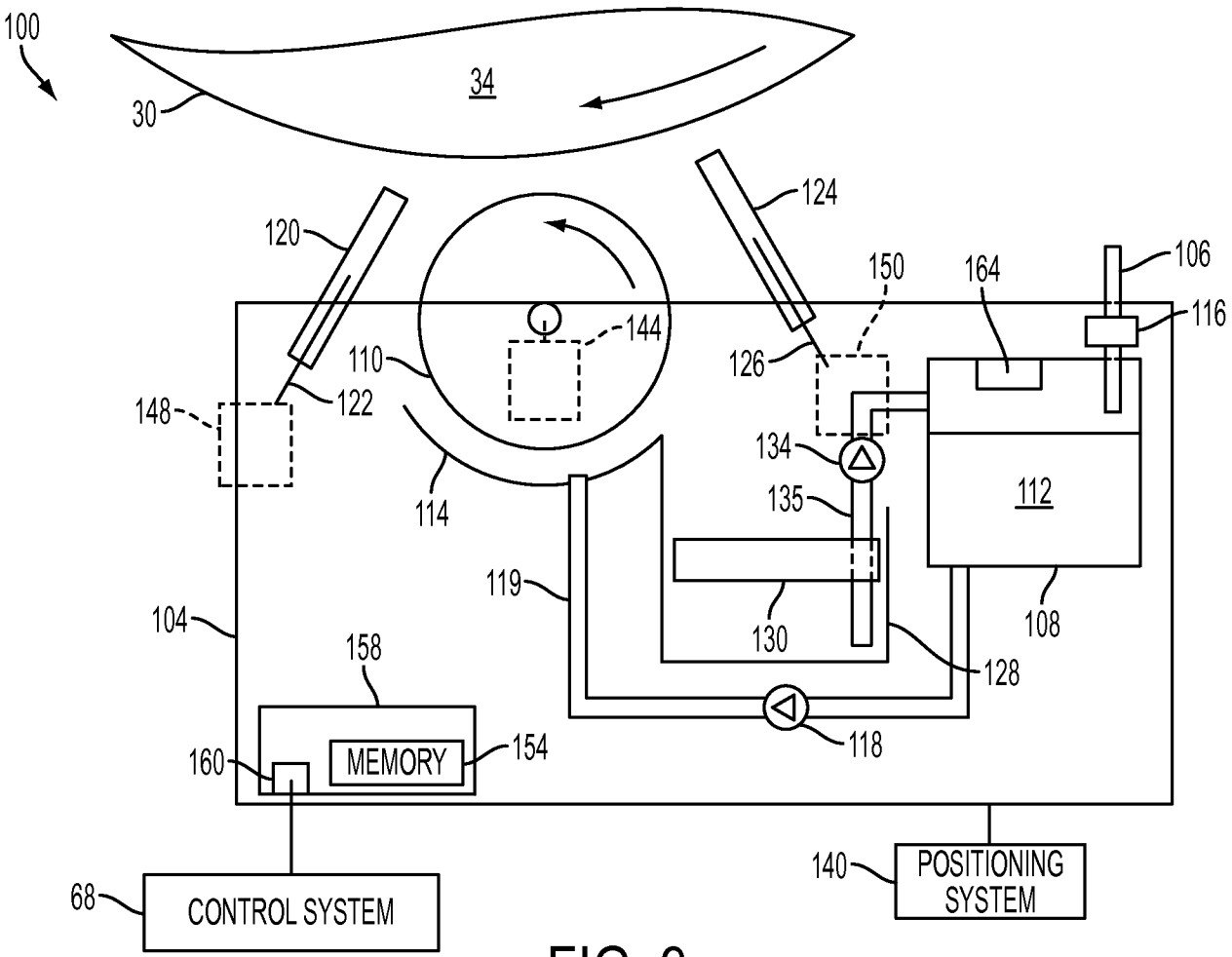
FIG. 3 is a schematic view of the drum maintenance system of FIG. 2 in a disengaged position with respect to the image transfer surface.

To facilitate transfer of an ink image from the drum to print media, the device 10 is provided with a release agent application system 100, referred to as a drum maintenance unit (DMU), for applying release agent to the surface 30 of the image receiving member 34. Referring to FIGS. 2 and 3, the DMU 100 includes a housing 104, a reservoir 108, an applicator 110, a reclaim area 114, a pump delivery system 118, a metering blade 120, a cleaning blade 124, a sump 128, a filter 130, a sump pump system 134, a positioning system 140, and a memory 154. In some embodiments, the DMU varies in some aspects from the one described and shown in the accompanying figures. For example, in some embodiments, the metering blade is also used as the cleaning blade.

The DMU housing 104 is formed of a material, such as molded plastic, that is compatible with the release agent used in the device 10 and that is capable of withstanding the environment within the housing 11 of the printer 10 during operational use of the printer. The reservoir 108 is positioned within the housing and is configured to hold a supply of release agent 112. A vent tube or conduit 106 fluidly connects the interior of the reservoir 108 to atmosphere to relieve any positive or negative pressure developed in the reservoir. The vent tube includes a solenoid valve 116 that is normally closed to prevent any oil leaks during shipping and customer handling. The solenoid valve 116 is opened as oil is being pumped into and out of the oil reservoir to allow the reservoir to vent to atmospheric pressure.

In some embodiments, the reservoir 108 is equipped with a pressure sensor 164, such as a pressure transducer, which is configured to directly or indirectly detect or measure the pressure in reservoir 108. As discussed below, the pressure sensor 164 may be used after a maintenance cycle is performed to determine a change in pressure in the reservoir as a result of pumping release agent to or from the reservoir. The change in pressure may then be used to determine a duration for maintaining the solenoid valve 106 opened after pumping has been completed to return the pressure to ambient.

The applicator 110 is configured to apply the release agent 112 to the transfer surface 30 after the release agent is pumped from the reservoir 108 by the pump 118. In the embodiment of FIG. 2, the applicator 110 comprises a roller formed of an absorbent material, such as extruded polyurethane foam. In other embodiments, the applicator 110 is provided in a number of other shapes, forms, and/or materials that enables release agent from the reservoir 108 to be supplied to the reclaim area 114 where the applicator 110 can absorb the release agent and apply it to the surface 30. For example, in other embodiments, the applicator 110 is comprised of a blotter or pad formed of an absorbent low-friction material that is pressed against the transfer surface 30 to apply release agent.

To facilitate saturation of the roller 110 with the release agent, the roller 110 is positioned over a reclaim area 114 in the form of a tub or trough, referred to herein as a reclaim trough. A release agent delivery system 118 is configured to pump release agent from the reservoir through a conduit 119, or other suitable flow path, to the reclaim trough 114. In one embodiment, the delivery system 118 comprises a peristaltic pump although any suitable type of fluid pump or fluid transport system may be used.

In the embodiment of FIG. 2, the reclaim trough 114 has a bottom surface that follows the cylindrical profile of the lower portion of the roller 110. The roller 110 is positioned with respect to the reclaim trough 114 so that it is partially submerged in release agent. In some embodiments, the bottom surface of the trough includes surface features (not shown), such as chevrons, that protrude from the surface and are shaped or angled to direct oil from the outer edges of the roller toward the center.

The metering blade 120 is positioned to meter the release agent applied to the surface 30 by the roller 110. The metering blade 120 may be formed of an elastomeric material, such as urethane, supported on an elongated metal support bracket 122. The metering blade 120 helps ensure that a uniform thickness of the release agent is present across the width of the surface 30. In addition, the metering blade 120 is positioned above the reclaim trough 114 so that excess oil metered from the surface 30 by blade 120 is diverted down the metering blade 120 and back to the reclaim trough 114.

The DMU 100 also includes a cleaning blade 124 that is positioned to scrape oil and debris, such as paper fibers, residual ink and the like, from the surface 30 prior to a fresh application of release agent by roller 110. In particular, after an image is fixed onto a print media, the portion of the drum upon which the image was formed is contacted by the cleaning blade 124. Similar to the metering blade 120, the cleaning blade 124 may be formed of an elastomeric material, such as urethane, supported on an elongated metal support bracket 126. The cleaning blade 124 is positioned above the sump 128 so oil and debris scraped off of the surface 30 are directed to the sump 128.

The sump 128 comprises a receptacle or compartment positioned to capture excess release agent delivered to the reclaim trough 114, as well as release agent, dust, dried ink, and other debris diverted from the transfer surface 30. The sump 128 is fluidly connected to the reservoir 108 by a conduit 135. A sump pump 134 is configured to pump release agent from the sump 128 through the conduit 135 to the reservoir 108. A filter 130 is positioned in the conduit 135 to clean ink, oil, and debris that must pass through the filter before entering the reservoir 108. In one embodiment, the sump pump 134 comprises a peristaltic pump although any suitable pumping system or method may be used that enables the release agent to be pumped to the reservoir from the sump 128.

In the embodiment of FIGS. 1 and 2, the DMU 100 is implemented as a customer replaceable unit (CRU). As used herein, a CRU is a self-contained, modular unit that enables all or most of the components of the CRU to be inserted into and removed from a printer as a functional self-contained unit. When implemented as a CRU, the components of the DMU, such as the housing 104, reservoir 108, release agent supply 112, applicator 110, and blades 120, 124 are configured in a modular form capable of being inserted into and removed from the housing 11 of the device 10 as single component. As depicted in FIG. 1, the device 10 includes a docking space or area 90 (shown schematically as a dotted line in FIG. 1) in the housing 11 that is configured to receive the DMU 100. The device 10 and/or the DMU housing 104 is provided with suitable attachment features (not shown), such as fastening mechanisms, latches, positioning guide features, and the like, to enable the correct placement and installation of the DMU 100 within the housing 11. In other embodiments, the DMU may be a single field replaceable unit (FRU) or a collection of FRUs.

The DMU 100 includes a positioning system 140 (FIG. 2) that enables the applicator 110, metering blade 120, and cleaning blade 124 to be selectively moved into and out of engagement with the surface 30 once the DMU is inserted into the housing. For example, the positioning system may include a moveable member that interacts with a cam in the housing 11 of the printing device 10. In the embodiment of FIG. 2, the positioning system 140 includes a separate respective positioning mechanism 144, 148, 150, such as a cam follower, for each of the applicator 110, metering blade 120, and cleaning blade 124 so that each may be moved into and out of engagement with the transfer surface 30 independently. The positioning mechanisms of the positioning system are configured to enable the applicator 110, metering blade 120, and cleaning blade 124 to be selectively and independently moved between a disengaged position (FIG. 3) spaced apart from the surface 30 and an engaged position (FIG. 2) in contact with the transfer surface 30. In an alternative embodiment, the positioning mechanism 140 is configured so the DMU is moved between an engaged position and a disengaged position with respect to the transfer surface as a unit.

Referring again to FIG. 2, the DMU 100 includes a memory device 154, such as an EEPROM, for storing operational values and other information pertaining to the DMU 100, including data and operational information pertaining to the gel-based life-sensing process for use by the control system. The memory includes a plurality of dedicated memory locations for storing information pertaining to the operation of the DMU, such as the initial mass of release agent stored in the reservoir, the estimated current mass of release agent in the reservoir, the total number of prints performed by the DMU, the number of prints that are simplex prints, the number of prints that are duplex, the total media area of the prints, and the total media area that has been covered with ink.

The memory 154 may be implemented in a circuit board 158 or other structure. The circuit board 158 includes a suitable connector 160 configured to releasably and electrically connect the circuit board 158 including memory 154 to the printer control system 68 when the DMU 100 is installed in the housing 11. Once the DMU 100 is inserted into the device 10 and the memory 154 is connected to the controller 70, the control system 68 selectively accesses the memory 154 to retrieve the operational values and selectively writes to the memory 154 to update the values during use. In this manner, DMU performance and life expectancy are tracked. In addition, various controllable components of the DMU 100, such as the solenoid valve 116, delivery pump 118, sump pump 134, pressure sensor 164, and the positioning mechanisms 144, 148, and 150 of the positioning system 140 are each operatively connected to the circuit board 158 so the control system 68 can control these components.

As a CRU, the DMU 100 has a fixed supply of release agent that is capable of providing oil for a limited number of prints depending on the capacity of the reservoir. In the embodiment of FIGS. 1-3, the reservoir of the DMU contains a supply of release agent capable of providing oil for approximately 300,000 to 500,000 prints based on an average usage of approximately 6 mg/print. The control system increments a print count value with every print performed by the DMU and compares the incremented print count to a predetermined print count threshold value. For the embodiment of FIGS. 1-3, the print count threshold value is set to 400,000 prints. The memory 154 of the DMU includes dedicated locations for storing the print count value and the print count threshold value. In other embodiments, these values are stored or maintained in other memory devices for later access by the control system.

When the print count value reaches the print count threshold value. (e.g., 400,000 prints), an EOL fault signal is generated indicating that the supply of release agent has been depleted. The DMU must then be removed from its location and replaced with a DMU having a fresh supply of release agent. In one embodiment, the fault signal represents a fault code that is configured to convey meaning to a fault handling system, a technician, or repair specialist of the imaging device. In some embodiments, the control system 68 is configured to output a fault signal as a message, alert, alarm, or other form of communication to an operator of the device via the user interface 78. In some embodiments, the control system 68 is configured to present textual, audio, and/or visual information to assist the operator in replacing the DMU. In some embodiments, a pre-EOL signal or notification is provided to enable printing to continue before a fault signal is issued.

As noted above, the ink material collected in the DMU may combine with the release agent to form a high viscosity gel that can adversely impact the performance of the DMU and possibly result in damage to the printer. Tests have shown that gel accumulation is driven by the ink-oil ratio in the DMU. For a given system, the ink-oil ratio is a function of DMU print count, the surface area of the prints, the percentage of the surface area covered with ink, the percentage of prints that are simplex, and the percentage of jobs that are duplex. High ink coverage prints and duplex prints typically take more oil from the DMU and result in more ink material being added to the DMU than low ink coverage prints and simplex prints, respectively. As a result, the ink-oil ratio increases faster in DMUs that perform a greater percentage of high coverage and/or duplex prints than printers that perform a lower percentage of high coverage and/or duplex prints. As the ink-oil ratio increases, the rate of gel accumulation in the DMU, and the accompanying risk of gel related failures, also increases. If the ink-oil ratio increases at a fast enough rate, gel related failures may occur prior to the print count threshold value of the DMU being reached. Extensive image density and ink coverage in a high count succession of prints may also exacerbate the formation of gel in the reclaimed ink. Alternatively, a high count succession of low density images may help reduce the level of gel buildup in the reclaimed ink.

In accordance with the present disclosure, the control system 68 of the imaging device 10 is configured to monitor the characteristics of the prints that impact the ink-oil ratio in the DMU. These characteristics include the surface area of the print, the percentage of the surface area covered with ink, the area of a printable region on the media that is imaged, and whether or not the print is simplex or duplex, which may account for factors other than the number of imaged sides. These characteristics, in some embodiments, also include image coverage relative to the number of prints over time or counts of prints. The control system 68 is configured to implement a gel-based life-sensing process that monitors these characteristics in conjunction with empirical test data and usage data to generate a gel score for the DMU. The gel score represents a statistical average of the prints overall contribution to the ink-oil ratio in the DMU.

The control system 68 updates the gel score in accordance with the process as each print is performed by the DMU until the gel score reaches a predefined gel score threshold value. The gel score threshold value is determined for the DMU with reference to one or more of the following: the amount of release agent in the DMU reservoir, print characteristics, the print count threshold value, scoring methodology, empirical test data, usage data, and customer preference as to when a gel related EOL fault should be generated. Customer usage data may be used to fine tune the gel score threshold value on a device-by-device or customer-by-customer basis. Empirical data may also be used to adjust multipliers and thresholds to make the process more or less conservative. When the gel score threshold value is reached, an EOL fault is generated to indicate that the DMU is in need of replacement due to risk of gel related failure.

In one embodiment, the gel score of the DMU corresponds substantially to an augmented print count. Each print is weighted according to its impact on the ink-oil ratio and gel accumulation in the DMU. The weight given to each print is related to the product of the percentage of the print covered with ink and a print type scaling factor. In some embodiments, weighting is also given to a collection of prints when image content exceeds an average or norm. The scaling factor is an empirically derived multiplier used to account for the different impact simplex and duplex prints have on the ink-oil ratio in the DMU. In one embodiment, the print type scaling factor is equal to 1, in the case of simplex prints, and is equal to 3.5, in the case of duplex prints.

A memory stores operation data and values for use by the control system in determining the gel score for the DMU. In one embodiment, the memory for the gel monitoring system includes the system memory 74. Alternatively, a separate memory may be provided in the DMU and/or the imaging device for the gel monitoring system. In the depicted embodiment, the memory includes dedicated memory locations for storing and tracking the characteristics of the prints performed by the DMU including a print count value, a simplex print count value, a total simplex print area value, a total simplex coverage area value, a total simplex fill percent value, a duplex print count value, a total duplex print area value, a total duplex coverage area value, and a total duplex fill percent. The memory also includes dedicated memory locations for a gel score value, a simplex gel score value, a duplex gel score value, and a gel score threshold value. The control system is configured to access the memory in order to retrieve and update the various values in accordance with a gel-based life-sensing process. The memory may also include memory locations for the storage of instructions and values used in updating and/or calculating the various values stored in the memory.

Figure 4:
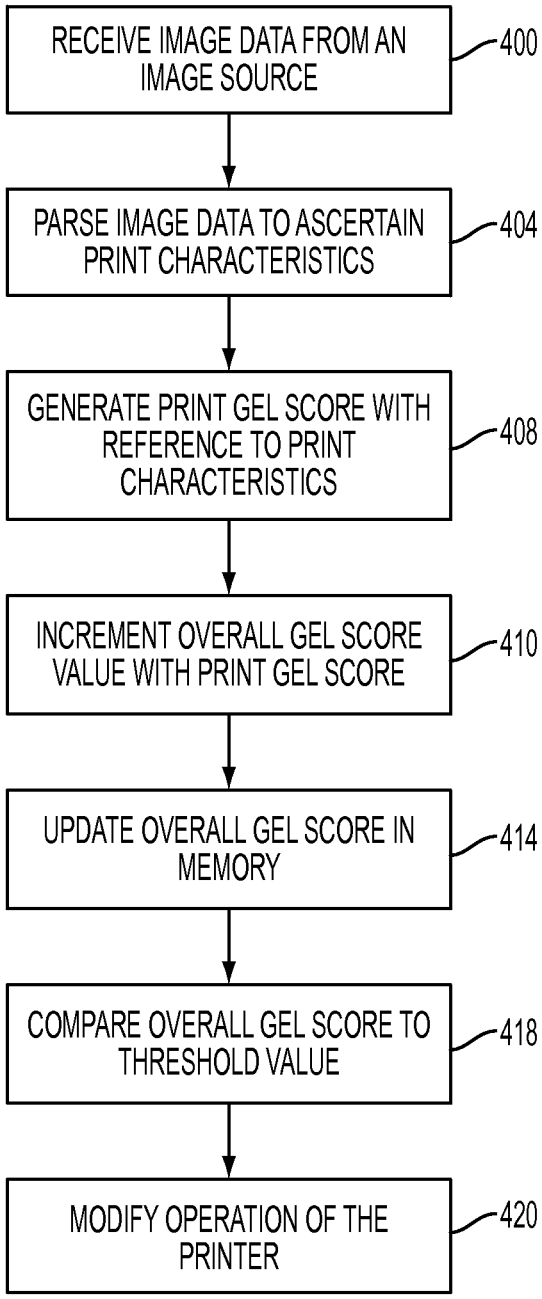
FIG. 4 is a flowchart of one embodiment of a gel-based life-sensing process.

FIG. 4 depicts a flowchart of one embodiment of a gel-based life-sensing process for use with the DMU. As used in this document, the words "identify" and "determine" include the operation of a circuit comprised of hardware, software, or a combination of hardware and software that reaches a result based on one or more measurements of physical relationships with accuracy or precision suitable for a practical application. According to the process, the control system receives image data pertaining to one or more print jobs from an image source (block 400), such as the scanner or a network work station. As each print is performed, the control system identifies the characteristics of the print(s) in a print job(s) (block 404) including the area of the print media (printMediaArea), the ink coverage area of the print (printPixelArea), and whether the print is simplex or duplex. The control system then generates a print gel score (printGelScore) with reference to these print characteristics (block 408). In one embodiment, the gel score (printGelScore) for each print is determined according to the formula:

$$\text{printGelScore}=\text{numberSides}*(1+\text{printFill\%}*\text{printTypeFactor}), \quad 1)$$

where numberSides is the printMediaArea divided by the area of A4 print media, printFill% is the printPixelArea divided by the printMediaArea, and printTypeFactor is equal to 1 (printTypeFactor=1) in the case of simplex prints and is equal to 3.5 (printTypeFactor=3.5) in the case of duplex prints. The control system may be configured to generate a gel score value and maintain a combined gel score value in any suitable manner. For example, instructions and operational data may be stored in a memory that is accessible by the control system, such as the DMU memory and/or the control system memory.

The control system then increments the overall gel score of the DMU (gelScore) with the print gel score (printGelScore) (block 410). For example, the control system accesses the memory to retrieve the overall gel score for the DMU (gelScore) and increments the overall gel score with the print gel score (i.e., gelScore=gelScore+printGelScore). The incremented gel score value is then stored in the memory (block 414). This process continues until the gel score value reaches a predefined gel score threshold value (block 418). The gel score threshold value (gelCountThresh) is predefined for the DMU with reference to the print count threshold value, scoring methodology, and empirical test data as to when gel failures are likely occur during DMU operation. For example, in one embodiment, with a print count threshold value of 400,000 A4 size prints, the gel score threshold value is 600,000 A4 size prints. When the gel score reaches the gel score threshold value, the process modifies the operation of the printer (block 420).

Figure 5:
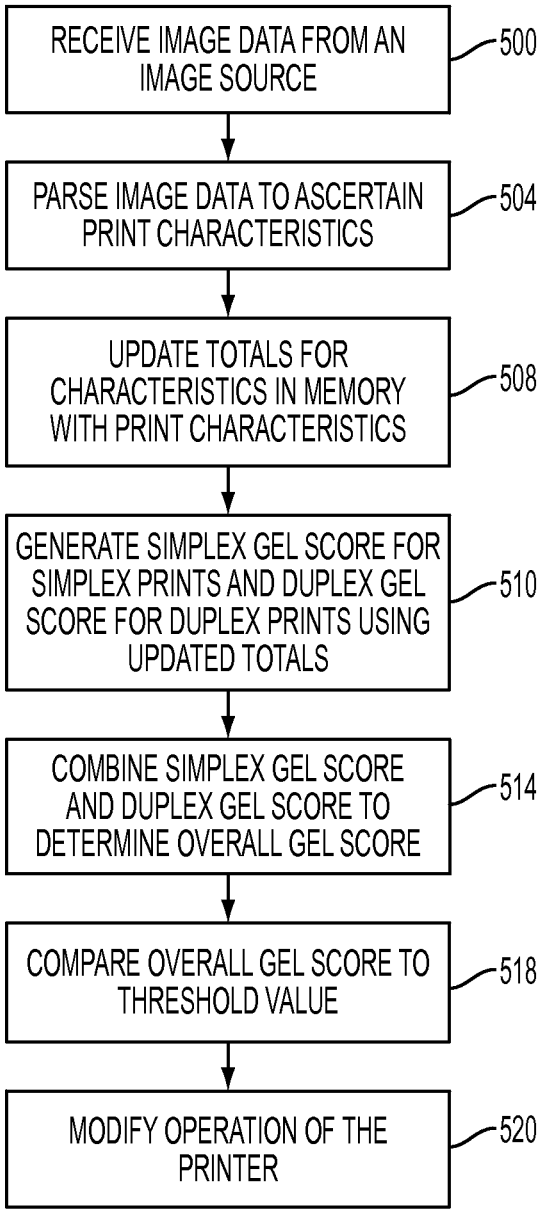
FIG. 5 is a flowchart of another embodiment of a gel-based life-sensing process.

In the embodiment of FIG. 4, the gel score for each print is calculated and then added to the overall gel score of the DMU. In an alternative embodiment, as depicted in FIG. 5, the control system may be configured to determine the overall gel score of the DMU based on the total values of the monitored characteristics of the prints performed by the DMU. For example, the control system may be configured to ascertain the characteristics of each print and to update the a print count value, a simplex print count value, a total simplex print area value, a total simplex coverage area value, a total simplex fill percent value, a duplex print count value, a total duplex print area value, a total duplex coverage area value, and a total duplex fill percent value for each print. The control system is then configured to calculate the overall gel score using the updated values stored in the memory.

In accordance with process depicted in FIG. 5, the control system maintains a separate gel score value for simplex prints (simplexGelScore) and duplex prints (duplexGelScore) that are combined to arrive at the combined gel score value (gelScore), as depicted in the flowchart of FIG. 5. For simplex prints, the control system maintains a total simplex media area value (simplexMediaArea) and a total simplex coverage level value (simplexPixelArea). For duplex prints, the control system maintains a total duplex media area value (duplexMediaArea) and a total duplex coverage level value (duplexPixelArea). In the embodiment of FIG. 5, the control system ascertains the characteristics of each print (block 504) including the area of the print media (printMediaArea), the ink coverage of the print (printPixelArea), and whether the print is simplex or duplex. The control system accesses the memory and updates the values stored in memory for the current print (block 508). For example, if the print is a simplex print, the control system adds the area of the print (printMediaArea) to the combined simplex area value (simplexMediaArea) and adds the print coverage level (printPixelArea) to the combined simplex coverage value (simplexPixelArea). Similarly, if the print is a duplex print, the control system adds the area of the print (printMediaArea) to the combined duplex area value (duplexMediaArea) and adds the print coverage level (printPixelArea) to the combined duplex coverage value (duplexPixelArea).

The control system generates a simplex gel score (simplexGelScore) (block 510) in accordance with the following formula:

$$\text{simplexGelScore}=\text{simplexSides}*(1+\text{simplexFill\%}*\text{simplexGelFactor}), \quad 2)$$

where simplexSides is the simplexMediaArea divided by the area of A4 print media, simplexFill% is the simplexPixelArea divided by the simplexMediaArea, and the simplexGelFactor is an empirically derived scaling factor used to account for the impact of simplex prints on the ink-oil ratio. In this embodiment, the simplexGelFactor is equal to 1 (simplexGelFactor=1).

The control system generates a duplex gel score (duplexGelScore) (block 510) in accordance with the following formula:

$$\text{duplexGelScore}=\text{duplexSides}*(1+\text{duplexFill\%}*\text{duplexGelFactor}), \quad 2)$$

where duplexSides is the duplexMediaArea divided by the area of A4 print media, duplexFill% is the duplexPixelArea divided by the duplexMediaArea, and the duplexGelFactor is an empirically derived scaling factor used to account for the impact of duplex prints on the ink-oil ratio. In this embodiment, the duplexGelFactor is equal to 3.5 (duplexGelFactor=3.5).

The control system determines the overall gel score by combining the simplex gel score and the duplex gel score (e.g., gelScore=simplexGelScore+duplexGelScore (units=A4 pages)) (block 514). The control system updates the simplex gel score, the duplex gel score, and the gel score with each print performed and compares the updated gel score (gelScore) to a predefined gel score threshold value (gelScoreThresh), e.g., 600,000 A4 size prints (block 518). When the gel score reaches the gel score threshold value, the process modifies the operation of the printer (block 520).

The modification of the printer operation noted above with reference to FIG. 4 and FIG. 5, in one embodiment, includes one of generating an EOL fault indicating that the DMU is at risk for gel related failures and needs to be replaced, operating the imaging device to perform a gel preventive operation, and operating the imaging device to perform a gel cleaning operation. A gel preventive operation is implemented in one embodiment at a predetermined threshold that is different than the predetermined threshold that leads to the performance of the gel cleaning operation with the predetermined threshold associated with the gel prevention operation being reached before the threshold associated with the gel cleaning operation is reached. The gel prevention operation in one embodiment is comprised of the release applicator being brought into contact with the rotating image receiving member as the image receiving member is rotated. In some embodiments, the cleaning and/or metering blades are also brought into contact with the image receiving member to help dislodge and remove the ink. These operations enable the release agent level on the member to increase to a degree that helps lift ink from the surface of the member, the surface of the cleaning or metering blades, or all of the image receiving member, metering blade, and cleaning blade. The number of revolutions, duration of either blade to the rotating surface, or the surface speed of the rotating member is selected to comport with the configuration of the printer. The gel cleaning operation is similar to the gel prevention operation except the duration of the operation is longer and includes more revolutions of the image receiving member against the release agent applicator and more revolutions in engagement with the cleaning and/or metering blades.

A gel life-sensing process in accordance with the present disclosure may be used in conjunction with other life-sensing processes for the DMU. For example, the control system maintains a print count value for the DMU. As each print is performed, the control system increments the print count and compares the incremented print count to a print count threshold value, e.g., 400,000 prints. If the print count reaches the print count threshold value prior to the gel score reaching the gel score threshold value, the control system generates an EOL fault indicating that the DMU is in need of replacement due to depletion of the supply of release agent. Similarly, if the gel score reaches the gel score threshold value prior to the print count reaching the print count threshold value, the control system generates an EOL fault indicating that the DMU is in need of replacement due to the risk of gel related failures.

The coverage or fill percentage of some prints may be low enough that the prints have a negligible impact on the ink-oil ratio and therefore the prints do not pose a significant risk of gel related failure. Therefore, in one embodiment, a fill percentage threshold value may be predefined for the prints to determine whether the gel score for the print is to be added to the combined gel score. The fill percentage threshold value may be set to any suitable value based on empirical test data, usage data, customer history, and preference. In the embodiment of FIG. 5, the coverage threshold value is set to 12% fill for simplex prints and 6% fill for duplex prints. The control system compares the print fill percentage value (printFill%=(printPixelArea/printMediaArea)) to the simplex fill percentage threshold value (simplexFillThresh%) in the case of simplex prints or the duplex fill percentage threshold value (duplexFillThresh%).

If the fill percentage of a print is less than the fill percentage threshold value, then the print is omitted from the calculation or determination of the gel score value for the DMU. For example, in one embodiment, the print fill percentage multiplied by the gel scaling factor (i.e, simplexFill%*simplexGelFactor, or duplexFill%*duplexGelFactor) represents a partial gel score value for the print. If the comparison indicates that the print fill percentage is less than the corresponding fill percentage threshold value, the partial gel score value for the print is omitted from the determination of the gel score. Referring to the formulas above for calculating the simplexGelScore and the duplexGelScore, if all simplex prints are below the simplex fill threshold value, e.g., 12%, and all duplex prints are below the duplex fill threshold value, e.g., 6%, then the simplex gel score (simplexGelScore) is equal to the number of simplex sides (simplexSides) and the duplex gel score (duplexGelScore) is equal to the number of duplex sides (duplexSides). As a result, the combined gel score (gelScore=simplexSides+duplexSides) is equal to the print count value for the DMU.

The above-described gel life-sensing process enables the mitigation of gel related failures by predicting when such failures are likely to occur and alerting an operator of the printer to replace the DMU prior to the occurrence of gel related defects and damage. Down time and costly service calls may therefore be avoided. Empirical data may be used to adjust process multipliers and thresholds to make the process more or less conservative. Customer usage, history, and preference data may be used to tune the process for specific uses, device types, applications, and customer requirements.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of monitoring a release agent application system of an imaging device, the method comprising:

identifying a plurality of print characteristics for a print to be printed by an imaging device;

generating a print gel score with reference to the plurality of print characteristics;

adding the print gel score to an overall gel score for a release agent application system of the imaging device;

comparing the overall gel score to a predetermined gel score threshold; and modifying operation of the imaging device in response to the comparison indicating that the overall gel score is greater than the predetermined gel score threshold.

2. The method of claim 1, the modification of the imaging device operation further comprising:

operating the imaging device to perform one of the following operations: generate a fault signal indicative of gel being in the release agent application system, operating the imaging device to perform a gel preventive operation, and operating the imaging device to perform a gel cleaning operation.

3. The method of claim 1, the plurality of print characteristics comprising:

a print area value identifying a total surface area of the print;

an inked area value identifying an area of the surface area covered with ink; and a print type indicating whether the print is a simplex print or a duplex print.

4. The method of claim 3, wherein the generation of the print gel score further comprises:

identifying a fill percentage for the print with reference to the print area value and the inked area value;

identifying a gel scaling factor with reference to the print type; and multiplying the fill percentage by the identified gel scaling factor to identify a partial gel score for the print.

5. The method of claim 4, wherein the generated print gel score for the print is a sum of a predetermined number and the partial gel score.

6. The method of claim 4, wherein the gel scaling factor is a first predetermined number for simplex prints and a second predetermined number for duplex prints, the second predetermined number being greater than the first predetermined number.

7. The method of claim 4 further comprising:

comparing the identified fill percentage to a fill percentage threshold; and omitting the partial gel score from the generation of the print gel score in response to the comparison to the fill percentage threshold indicating that the identified fill percentage is less than the fill percentage threshold.

8. The method of claim 7, wherein the fill percentage threshold is a first predetermined percentage for simplex prints and a second predetermined percentage for duplex prints, the second predetermined percentage being less than the first predetermined percentage.

9. A method of monitoring a release agent application system of an imaging device, the method comprising:

identifying a plurality of print characteristics for a print performed by an imaging device, the plurality of print characteristics including a print area value identifying a total surface area of the print, an inked area value identifying an area of the surface area covered with ink, and a print type indicating whether the print is a simplex print or a duplex print;

incrementing a total simplex print area value and a total simplex inked area value in response to the print type indicating that the print is a simplex print;

incrementing a total duplex print area value and a total duplex inked area value in response to the print type indicating that the print is a duplex print;

generating a simplex gel score with reference to the total simplex print area value and the total simplex inked area value;

generating a duplex gel score with reference to the total duplex print area value and the total duplex inked area value;

summing the simplex gel score and the duplex gel score to generate an overall gel score;

comparing the overall gel score to a predetermined gel score threshold; and modifying operation of the imaging device in response to the comparison to the predetermined gel score threshold indicating the overall gel score is greater than the gel score threshold.

10. The method of claim 9, the modification of the imaging device operation further comprising:

operating the imaging device to perform one of the following operations: generate a fault signal indicative of gel being in the release agent application system, operating the imaging device to perform a gel preventive operation, and operating the imaging device to perform a gel cleaning operation.

11. The method of claim 9, the generation of the simplex gel score and the duplex gel score further comprising:

identifying a simplex fill percentage for simplex prints with reference to the total simplex area value and the total simplex inked area value;

identifying a duplex fill percentage for duplex prints with reference to the total duplex area value and the total duplex inked area value;

multiplying the simplex fill percentage by a first gel scaling factor to identify a simplex partial gel score; and multiplying the duplex fill percentage by a second gel scaling factor to identify a duplex partial gel score.

12. The method of claim 11 further comprising:

adding the simplex partial gel score to a total simplex print count value to generate the simplex gel score; and adding the duplex partial gel score to a total duplex print count value to generate the duplex gel score value.

13. The method of claim 11, wherein the first gel scaling factor is a first predetermined number and the second gel scaling factor is a second predetermined number, the second predetermined number being greater than the first predetermined number.

14. The method of claim 9, wherein the predefined gel score threshold value is 600,000.

15. The method of claim 9 further comprising:

accessing a memory to retrieve the total simplex print area value, the total simplex inked area value, the total duplex print area value, and the total duplex inked area value; and after being incremented, updating the total simplex print area value, the total simplex inked area value, the total duplex print area value, and the total duplex inked area value in the memory.

16. The method of claim 11 further comprising:

comparing the simplex fill percentage to a predetermined simplex fill percentage threshold; and omitting the simplex partial gel score value from the generation of the simplex gel score in response to the comparison to the predetermined simplex fill percentage threshold indicating that the simplex fill percentage is less than the predetermined simplex fill percentage threshold.

17. The method of claim 11 further comprising:

comparing the duplex fill percentage to a predetermined duplex fill percentage threshold; and omitting the duplex partial gel score value from the generation of the duplex gel score in response to the comparison to the predetermined duplex fill percentage threshold indicating that the duplex fill percentage is less than the predetermined duplex fill percentage threshold.

18. The method of claim 17, wherein the simplex fill percentage threshold is a first predetermined percentage and the duplex fill percentage threshold is a second predetermined percentage, the second predetermined percentage being less than the first predetermined percentage.

* * * * *